United States Patent [19]

James et al.

[11] 4,309,707

[45] Jan. 5, 1982

[54] RADIO ANTENNAE STRUCTURES EMPLOYING HELICAL CONDUCTORS

[75] Inventors: James R. James; William James; Robert J. Drewett, all of Swindon, England

[73] Assignee: National Research Development Corporation, London, England

[21] Appl. No.: 145,502

[22] Filed: Apr. 29, 1980

[30] Foreign Application Priority Data

May 8, 1979 [GB] United Kingdom ..... 15835/79

[51] Int. Cl.[3] ..... H01Q 1/36

[52] U.S. Cl. ..... 343/895

[58] Field of Search ..... 343/700, 916

[56] References Cited

U.S. PATENT DOCUMENTS 2,153,975 4/1939 Smith et al. ..... 343/749

2,966,678 12/1960 Harris ..... 343/895

*Primary Examiner*—Eli Lieberman

*Attorney, Agent, or Firm*—Cushman, Darby & Cushman

[57] ABSTRACT

The invention relates to compact radio antennae structures having wide bandwidth characteristics, the antennae structure including a plurality of end-fed antennae, and a terminal connected to end feed the antennae, wherein each of the antennae comprise a pair of extended conductors disposed in helical insulated windings of the same diameter and opposite chirality, the windings being coaxially, longitudinally coextensive and connected together at one end to form said end-feed, and wherein the antennae are each of different electrical lengths.

4 Claims, 12 Drawing Figures

RADIO ANTENNAE STRUCTURES EMPLOYING HELICAL CONDUCTORS

The present invention relates to radio antennae structures and in particular relates to structures which are arrays of end-fed antennae.

The invention provides a compact radio antenna structure having wide bandwidth characteristics.

According to the present invention a radio antenna structure includes a plurality of end-fed antennae, said antennae each comprising a pair of extended conductors disposed in helical, insulated winds of the same diameter and opposite chirality, are coaxial and longitudinally co-extensive and are connected together at one end to form said end-feed, wherein the antennae are each of different electrical lengths and are fed from a single conductor.

The axes of the antennae may be coplanar and diverge radially outwardly from the end feed.

In particular form of the invention the structure comprises a pair of the antennae of which the axes define an included angle of at least 30°.

In one form of the invention the axes antennae are parallel.

Embodiments of the invention will now be described, by way of example only, with reference to the drawings of which:

Figure 1:
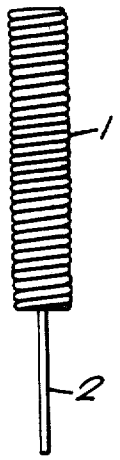
FIG. 1 is a side elevation of a coaxial helical antenna which forms part of the radio antenna structure in accordance with the invention.

Referring to FIG. 1, the coaxial helical antennae shown therein is the subject of a copending application U.S. Ser. No. 808,384, now U.S. Pat. No. 4,160,979. The antenna of FIG. 1 comprises a first helical winding of insulated copper wire wound around a cylindrical former, and a second helical winding of insulated copper wire wound over the first winding. The two windings 1 are joined together at the lower end which forms the connection to the antennae so that they effectively constitute a single conductor 2. The winds are also joined at the other end. The windings are coaxial and consist of 760 turns of 24 SWG on the 22 mm former. The windings have the same longitudinal extent of 450 mm, and the same number of turns but are wound in the opposite sense.

Figure 2:
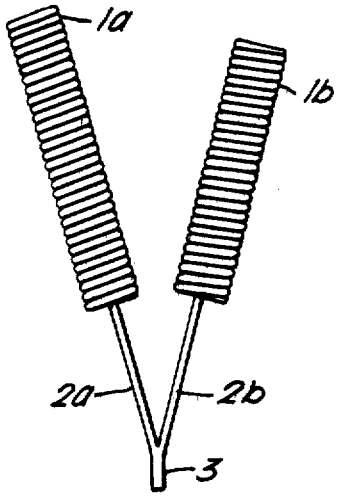
FIG. 2 is a side elevation view of a radio antenna structure in accordance with the invention, which includes a pair of the antennae of FIG. 1.

The antennae structure of FIG. 2 comprises a pair of coaxial helical antennae 1*a* and 1*b* of the construction generally as described above in respect of FIG. 1 but of different electrical lengths. The antennae have end feeds, 2*a* and antennae 1*a* and 2*b* on antenna 1*b*. The axes of the antennae 1*a* and 1*b* define an included angle of about 30°. The feeds 1*a* and 2*b* and soldered together at their lower ends to a common feed 3 of copper wire.

Figure 3:
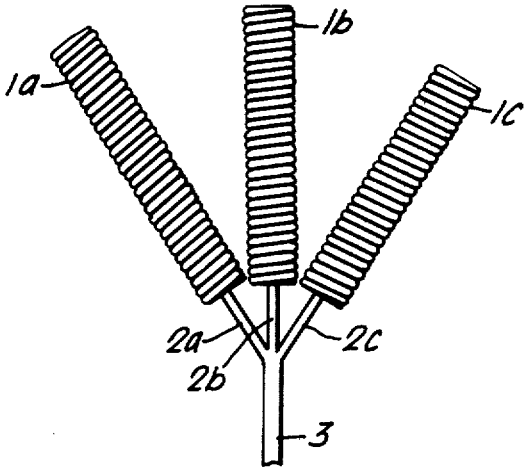
FIG. 3 is a side elevation of a further radio antenna structure in accordance with the invention, which includes three of the anntennae of FIG. 1.
Figure 4:
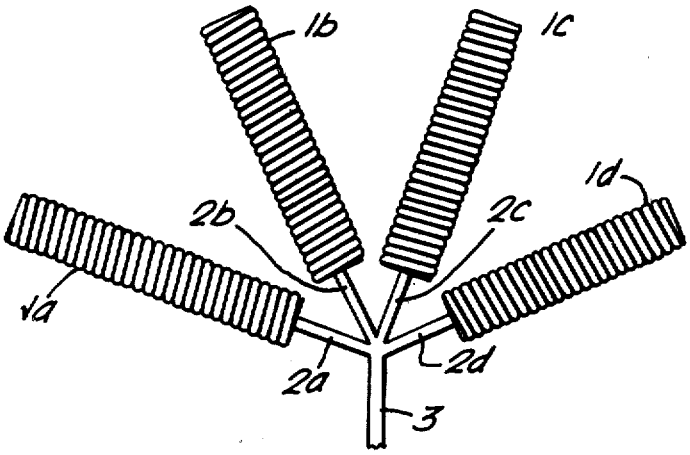
FIG. 4 is a side elevation of a yet further radio antenna structure in accordance with the invention which includes four of the antennae of FIG. 1.

The common antennae structures shown in FIGS. 3 and 4 are of similar construction to that of FIG. 2 but the antennae in each structure are of different electrical lengths and have three coplanar antennae 1*a*, 1*b*, 1*c*, four coplanar antennae 1*a*, 1*b*, 1*c* and 1*d* respectively. The antennae in each structure are joined to a single feed 3 and have included angles of about 30° between adjacent antennae.

Figure 5:
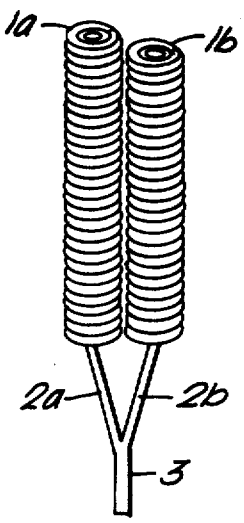
FIG. 5 is a perspective view of a pair of the antennae of FIG. 1, in which the antennae axes are parallel and which constitute a structure in accordance with the invention.
Figure 6:
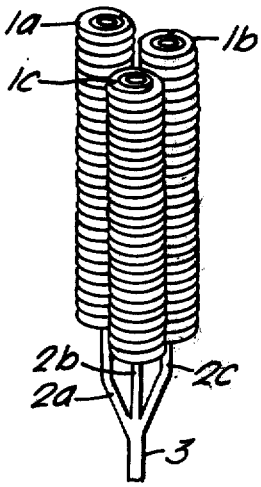
FIG. 6 is a perspective view of a cluster of three of the antennae of FIG. 1 in which the antennae axes are parallel.

The antennae structures shown in FIGS. 5 and 6 include two antennae 1*a* and 1*b* and three antennae 1*a*, 1*b* and 1*c* respectively, the antennae being of the same construction as the antennae of FIG. 1 but of different electrical lengths. The axes of the antennae are parallel and each structure has a common feed 3.

The performance of the antennae described above will now be described with reference to FIGS. 7 to 12 which are graphs of relative impedance level against frequency.

Figure 7:
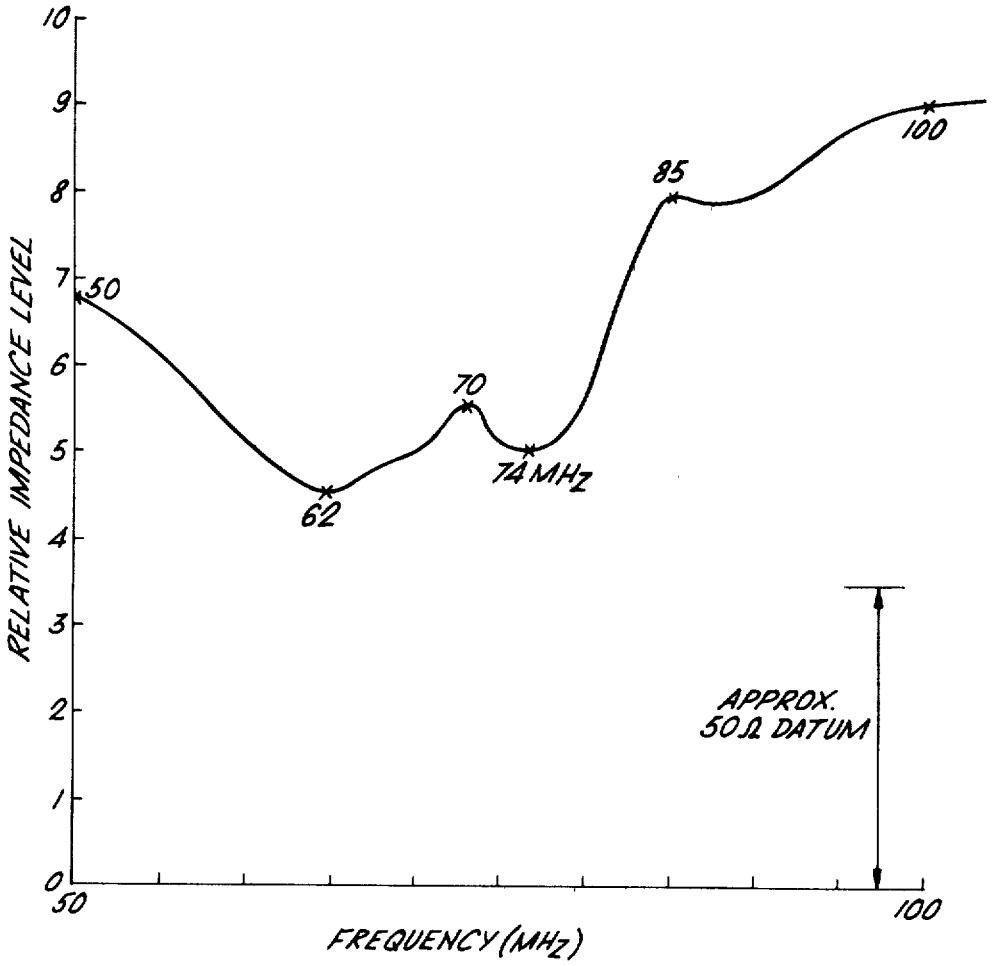
FIG. 7 is a graph showing the resonance characteristics and impedance level of a conventional wire monopole 115 mm long.

FIG. 7 shows results obtained over a range of 50 to 100 MHz for a single quarter wave monopole which is constructed from 10 SWG copper wire and extends 1115 mm from a ground plane.

Figure 8:
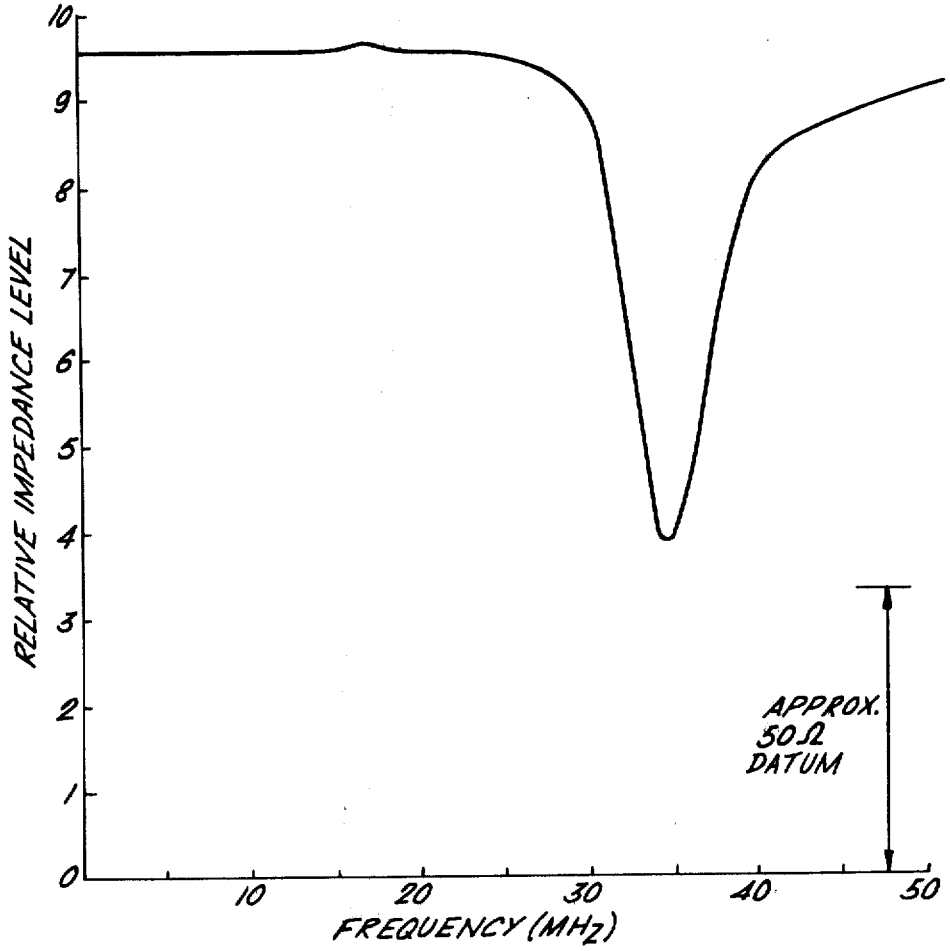
FIG. 8 is a graph showing impedance level and resonance characteristics for the single antenna of FIG. 1.

FIG. 8 shows results obtained for the antennae of FIG. 1. The antennae has a single well defined resonance of about 35 MHz. Such as antenna has a relatively narrow bandwidth.

Figure 9:
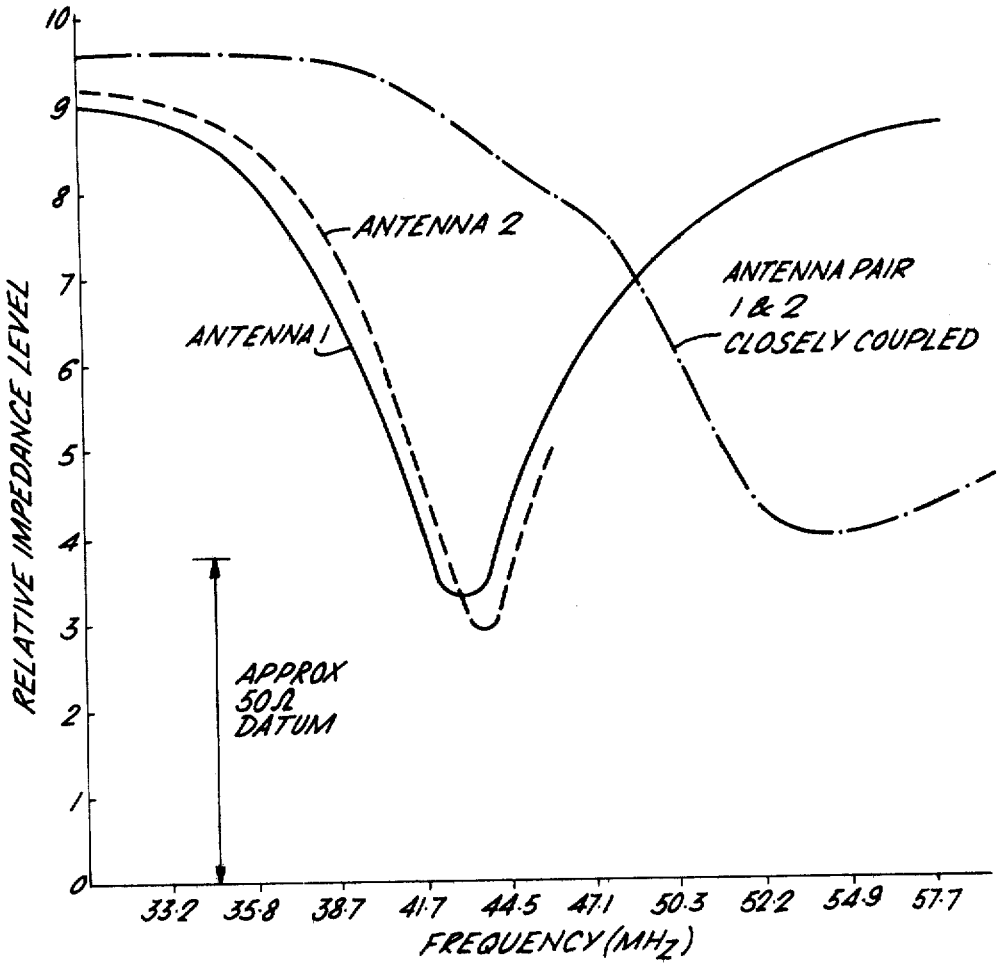
FIG. 9 is a graph showing impedance level and resonance characteristics for two similar antennae A and B each having the configuration shown in FIG. 1 and for the antennae pair of FIG. 5 which includes antennae A and B.

FIG. 9 shows results obtained for two antennae indicated as antennae 1 and 2 of the same general construction as that shown in FIG. 1 but of different electrical lengths, and for the antennae of FIG. 5 which includes the antennae 1 and 2 in closely coupled, parallel axes arrangement. It can be seen from FIG. 9 that by coupling the antennae the resonant frequency is increased and, more importantly the bandwidth is increased compared with that of either antennae 1 or 2.

Figure 10:
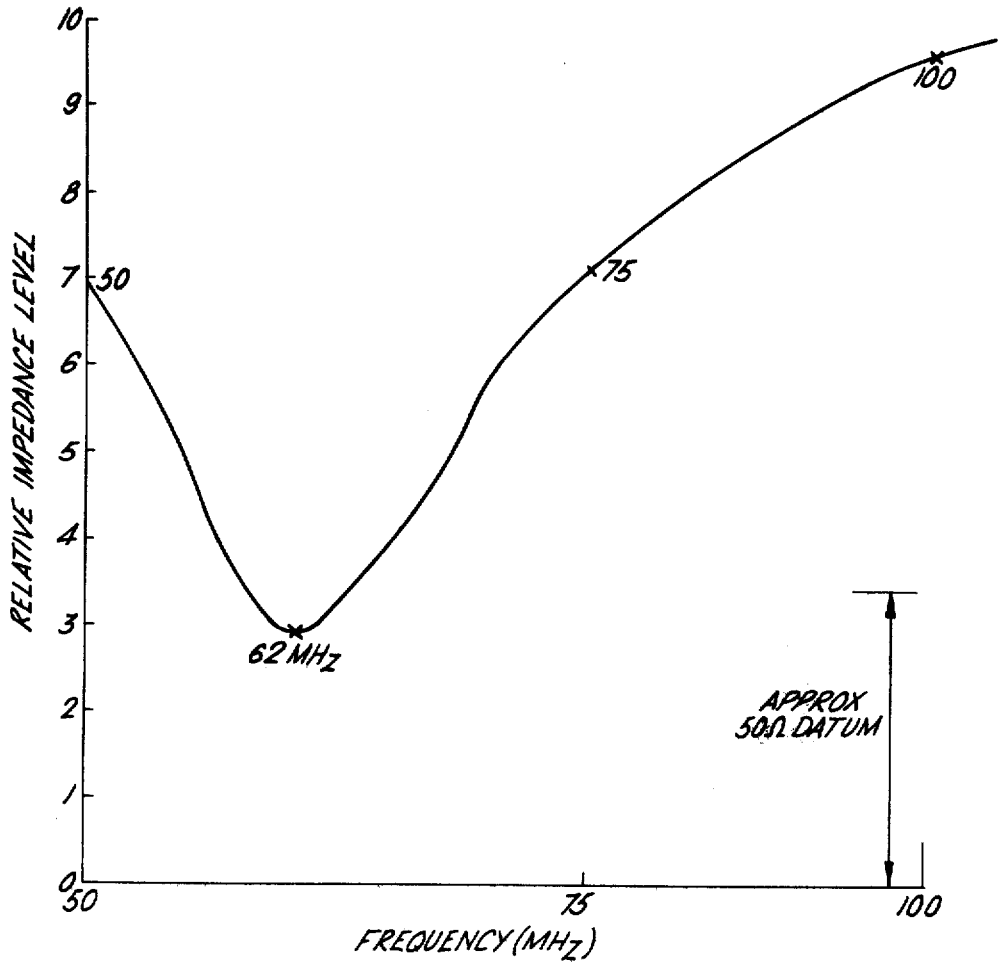
FIG. 10 is a graph showing impedance level and resonance characteristics for the antennae structure of FIG. 3 which includes antennae A and B and a third antenna C.

FIG. 10 shows results obtained for the antennae structure of FIG. 6. The resonant frequencies of the individual antennae of the structure of FIG. 6 were 44, 44 and 62 MHz. Again, a wider bandwidth was obtained by forming this structure from individual antennae.

Figure 11:
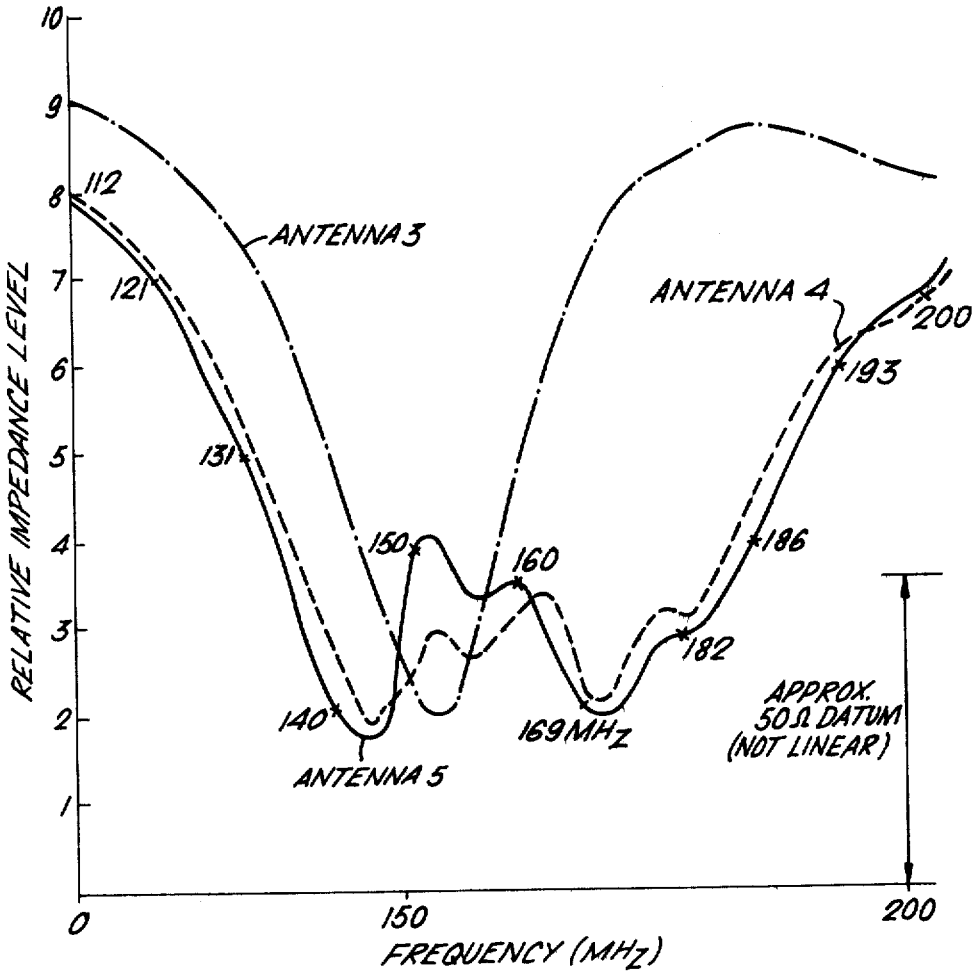
FIG. 11 is a graph showing impedance level and resonance characteristics for the antennae structures of FIGS. 9, 10 and the antenna of FIG. 1.

FIG. 11 shows results obtained for an antenna 3 of the same general construction as that of FIG. 1, an antenna 4 shown in FIG. 2, and antennae structure 5 as shown in FIG. 3. The results show that by forming the structures 4 and 5 a wider bandwidth than the single antenna 3 is obtained. However, a multiple peak response is obtained for both antennae 4 and 5. It will be seen that the results from a parallel axis structure such as that shown in FIG. 9 show a smoother, monopeak, response compared with the structures of FIGS. 2 and 3.

Figure 12:
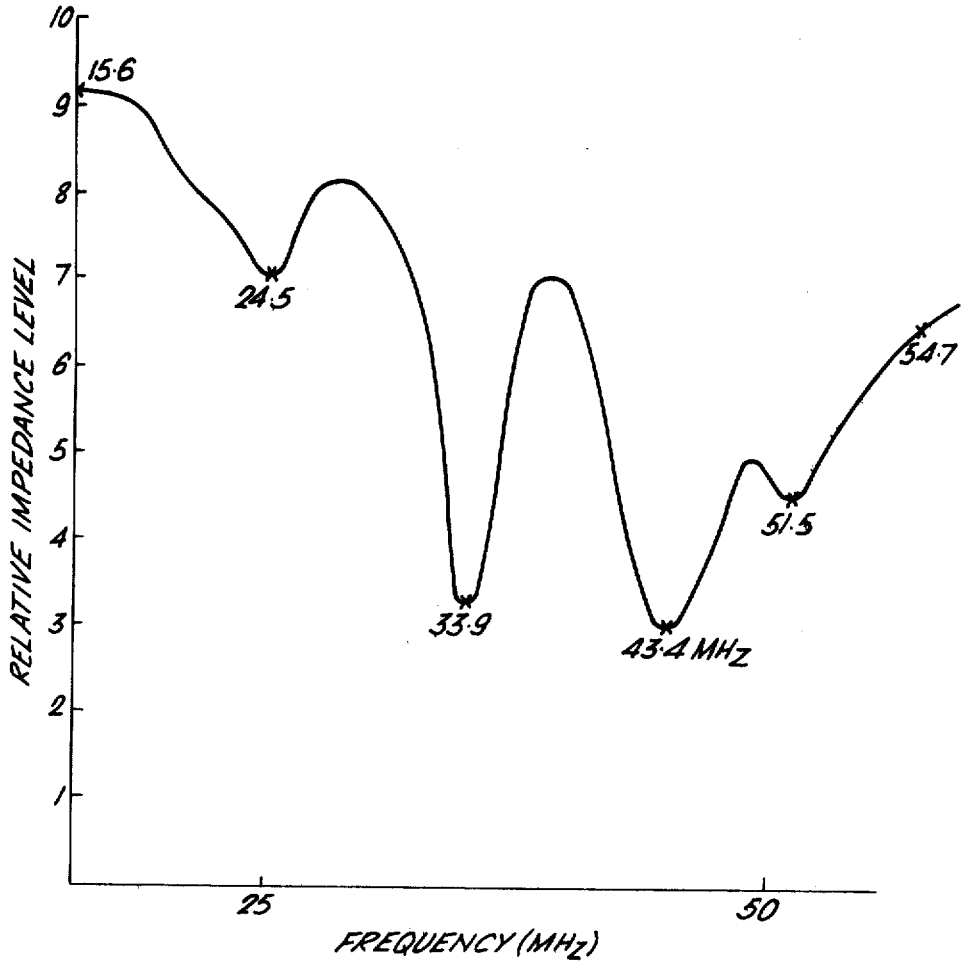
FIG. 12 is a graph showing impedance level and resonance characteristics for the antennae structure of FIG. 4.

Finally the result for the antennae structure of FIG. 4 are given in FIG. 12. The resonant frequencies of the individual antenna of the structure were 24.5, 33.9, 43.4 and 51.5 MHz and it can be seen from the curve in FIG. 12 that these frequencies appear as resonance frequencies for the antennae structure giving a wider bandwidth than any of the individual antennae but giving a peaky response. Similar results are exhibited for antennae structures which have non-coplanar axes.

We claim:

1. A radio antenna structure including a plurality of end-fed antennae, and a terminal connected to end feed said antennae, wherein each of said antennae comprise a pair of extended conductors disposed in helical insulated windings of the same diameter and opposite chirality, said winds being coaxial, longitudinally coextensive and connected together at one end to form said end-feed, and wherein the antennae are each of different electrical lengths.

2. A radio antenna structure as in claim 1 wherein said antennae have coplanar axes which diverge outwardly from said terminal.

3. A radio antenna as in claim 2 wherein said axes diverge at an angle of about 30°.

4. A radio antenna structure as in claim 1 wherein said antennae have parallel axes.

* * * * *